United States Patent [19]

Haag

[11] 4,446,614

[45] May 8, 1984

[54] METHOD OF MANUFACTURING A CONTROL DEVICE

[75] Inventor: Donald L. Haag, Sterling, Ill.

[73] Assignee: General Electric Company, Fort Wayne, Ind.

[21] Appl. No.: 349,329

[22] Filed: Feb. 16, 1982

[51] Int. Cl.[3] ..... H01H 11/00

[52] U.S. Cl. ..... 29/622; 200/83 A; 200/83 J; 200/83 P; 200/83 SA; 200/159 A; 307/118

[58] Field of Search ..... 307/118, 144, 132 EA; 200/81.4, 83 SA, 1 B, 83 P, 83 S, 83 W, 81 R, 81.5, 5 C, 6 R, 6 C, 83 J, 67 R, 67 D, 67 DA, 83 A, 159 A, 159 B; 29/622

[56] References Cited

U.S. PATENT DOCUMENTS

| | | | |
|---|---|---|---|
| 2,050,479 | 8/1936 | Winther | 200/1 B |
| 2,134,323 | 10/1938 | Beach | 200/1 B |
| 2,430,286 | 11/1947 | Flegel | 200/1 B |
| 2,766,350 | 10/1956 | Gres et al. | 200/83 P |
| 2,939,928 | 6/1960 | Learn | 200/81.5 |
| 3,052,788 | 9/1962 | Peters | 200/5 C |
| 3,194,916 | 7/1965 | Vischer, Jr. | 200/83 S |
| 3,277,441 | 10/1966 | Gutjahr | 200/81.4 |
| 4,256,973 | 3/1981 | Kochanski et al. | 307/118 |

OTHER PUBLICATIONS

Rueger, W. J., Pneumatic Switch, IBM Technical Disclosure Bulletin, vol. 10, No. 8, Jan. 1968, p. 1109.

*Primary Examiner*—Carl E. Hall
*Assistant Examiner*—P. W. Echols
*Attorney, Agent, or Firm*—Joseph E. Papin

[57] ABSTRACT

A method of manufacturing a control device includes interconnecting a switch segment with a terminal and another switch segment and mounting a plurality of electrical circuit elements within a housing with contact sections of the electrical circuit elements being located in different preselected elevations therein, respectively. The terminal is associated with the housing with the another switch segment extending in overlaying spaced apart relation with the contact sections of the electrical circuit elements located in the housing. A method of operating a control device and a control device are also disclosed.

5 Claims, 11 Drawing Figures

METHOD OF MANUFACTURING A CONTROL DEVICE

CROSS-REFERENCE TO RELATED APPLICATIONS

This application is related to the commonly assigned George E. Morris application Ser. No. 349,377 filed Feb. 16, 1982 (now U.S. Pat. No. 4,414,820 issued Nov. 15, 1983) entitled "Electrical Circuit And Method Of Controlling Such", the commonly assigned Thomas W. Brown application Ser. No. 349,378 filed Feb. 16, 1982 (now U.S. Pat. No. 4,408,466 issued Oct. 11, 1983) entitled "Electrical Circuit And Method Of Operating Such", and the commonly assigned George E. Morris and Stewart A. Woodward application Ser. No. 349,330 filed Feb. 16, 1982 (now U.S. Pat. No. 4,400,628 issued Aug. 23, 1983) entitled "Control Device And Method Of Making", and each of these aforementioned related applications filed concurrently with this application is incorporated herein by reference.

FIELD OF THE INVENTION

This invention relates in general to electrical switching devices and in particular to a method of manufacturing a control device.

BACKGROUND OF THE INVENTION

In the past, various different types of control devices, such as fluid pressure actuated switches for instance, were utilized in an automotive type air conditioning system to control the energization and deenergization of a clutch operated compressor in such system in response to a monitored fluid pressure therein, such as the fluid pressure in an accumulator of such system for instance.

In some of the past control devices, a fluid pressure responsive member, such as a diaphragm or the like for instance, was sealably interposed in a control device housing so as to define therein a fluid pressure chamber and a switch means accommodating chamber adjacent opposite sides of the diaphragm, respectively. A snap disc, which may have various different configurations so as to be movable between a stable configuration and an unstable configuration, was provided with a circumferential edge seated in the switch means accommodating chamber on the control device housing and adjacent the diaphragm, and switch means operable generally between make and break positions for controlling an electrical circuit through the control device was disposed in the switch means accommodating chamber generally adjacent the snap disc. Thus, the diaphragm was movable in response to a preselected fluid pressure acting thereon in the fluid pressure chamber to effect the application of a motive or applied force to the snap disc thereby to cause snap-action movement of the snap disc from the stable configuration thereof toward the generally inverted or unstable configuration thereof. When the snap disc was so moved to its unstable configuration, it effected the movement of the switch means from its break position to its make position. Thereafter, in response to a preselected reduction in the fluid pressure in the fluid pressure chamber which effected a corresponding reduction in the motive force applied by the diaphragm to the snap disc, the snap disc returned with snap-action from its unstable configuration to its stable configuration thereby to permit the return movement of the switch means from its make position to its break position. Of course, in its make and break positions, the switch means completed and interrupted the circuit through the control device which effected the energization and deenergization of the aforementioned clutch device controlled or actuated compressor, respectively.

One of the disadvantageous or undesirable features of at least some of the past control devices is believed to be that the transition of the snap disc between the stable and unstable configurations thereof resulted in objectionable noise, such as a clicking noise for instance, which was audible in the passenger compartment of the automobile. For instance, since these control devices were mounted to the air conditioner accumulator, it is believed that the aforementioned objectionable noise was transmitted directly into the passenger compartment of the automobile. Another disadvantageous or undesirable feature of the past control devices is believed to be that the pumping action of the diaphragm resulting from the snap-action of the snap disc effected an undesirably large movement of ambient atmospheric air into and out of the switch means accommodating chamber of such control device; therefore, under certain atmospheric conditions, such pumping of the ambient air is believed to have resulted in the formation of condensation and/or the formation of frost within the switch means accommodating chamber of such control device which is also believed to be a disadvantageous or undesirable feature.

In other types of the past control devices, a diaphragm was operable in response to different preselected values of a monitored fluid pressure supplied thereto for actuating a plurality of generally in-line arranged switches. In this arrangement, a spacer or plunger was driven by the diaphragm, and a plurality of shoulders on the plungers were seated in engagement with the switch blades of the switches. In response to concerted switch actuating movement of the diaphragm and the plunger, the plunger shoulders were successively disengaged from the switch blades generally as respective ones of the switches attained their switching positions thereby to effect sequential actuation of such switches. Of course, in the make and break switching positions of the switch plurality discussed above in this other type of past control device, the switches sequentially completed and interrupted the circuit through such control device to effect the energization and deenergization of the aforementioned clutch controlled compressor in the automotive type air conditioning system upon the occurrence of different preselected values of the monitored fluid pressure therein. At least one of the disadvantageous or undesirable features of at least some of these other past control devices is believed to be the cost involved in providing a plurality of in-line switches of the blade type as well as the difficulties involved in the assembly of such in-line switch arrangements.

SUMMARY OF THE INVENTION

Among the several objects of the present invention may be noted the provision of an improved method of manufacturing or assembling a control device which overcomes the aforementioned disadvantageous or undesirable features, as well as others, of the prior art; the provision of such improved method which utilizes a single switching means for effecting a plurality of sequential conductivity modes in the control device; the provision of such improved method in which the switching means is both pivotal and rockable in the plurality of sequential conductivity modes thereof; the provision of such improved method in which the switching means thereof utilizes a switch element having a configuration conducive to both pivotal and rocking movement so as to effect the plurality of sequential conductivity modes; the provision of such improved method in which the configuration of the switch element of the switching means inherently effects a peeling action upon the pivoting and rocking thereof which increases the ability to overcome contact contaminates and contact weld breaking; and the provision of the improved method having components which are simplistic in design, easily assembled and connected, and economically manufactured. These as well as other objects and features of the present invention will be in part apparent and in part pointed out hereinafter.

In general and in one form of the invention, a method is provided for manufacturing a control device having a plurality of electrical circuit elements with some of the electrical circuit elements respectively including a contact section thereon and another of the electrical circuit elements including a pair of switch segments with at least one of the switch segments having a free end portion interposed between a pair of generally opposite sides thereof. In this method, the electrical circuit elements are formed with the contact sections on the some electrical circuit elements, respectively, and with the other of the switch segments of the another electrical circuit element interconnected with the at least one switch segment at least generally adjacent the free end portion thereof so that the other switch segment extends at least in part generally in coplanar relation with the at least one switch segment beyond either opposite side thereof. The some electrical circuit elements are associated with the control device, and the respective contact sections of the some electrical circuit elements are arranged at different elevations. The another electrical circuit element is associated with the control device, and the switch segments are disposed so that the another switch extends in overlaying spaced apart relation with the respective contact sections of the some electrical circuit elements.

Also in general and in one form of the invention, a method is provided for manufacturing a control device having a housing with a chamber therein, a plurality of electrical circuit elements each with a contact section, and a switch and terminal assembly. The switch and terminal assembly includes a terminal and a pair of switch segments with one of the switch segments having a pair of opposite sides interconnected between a pair of opposite end portions, respectively. In practicing this method, one of the opposite end portions of the one switch segment is pivotally interconnected with the terminal, and the other of the switch segments is integrally formed with the one switch segment at least generally adjacent the other of the opposite end portions thereof so that the other switch segment extends beyond either opposite side on the one switch segment. The electrical circuit elements and the terminal of the switch and terminal assembly are mounted to the housing with at least the contact sections and the switch segments being disposed within the chamber, the contact sections are arranged at different preselected elevations within the chamber with at least one of the one and other switch segments being in overlaying relation with the contact sections of the electrical circuit elements.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting the scope of the invention in any manner.

DETAILED DESCRIPTION OF THE PREFERRED EMBODIMENTS

Figure 1:
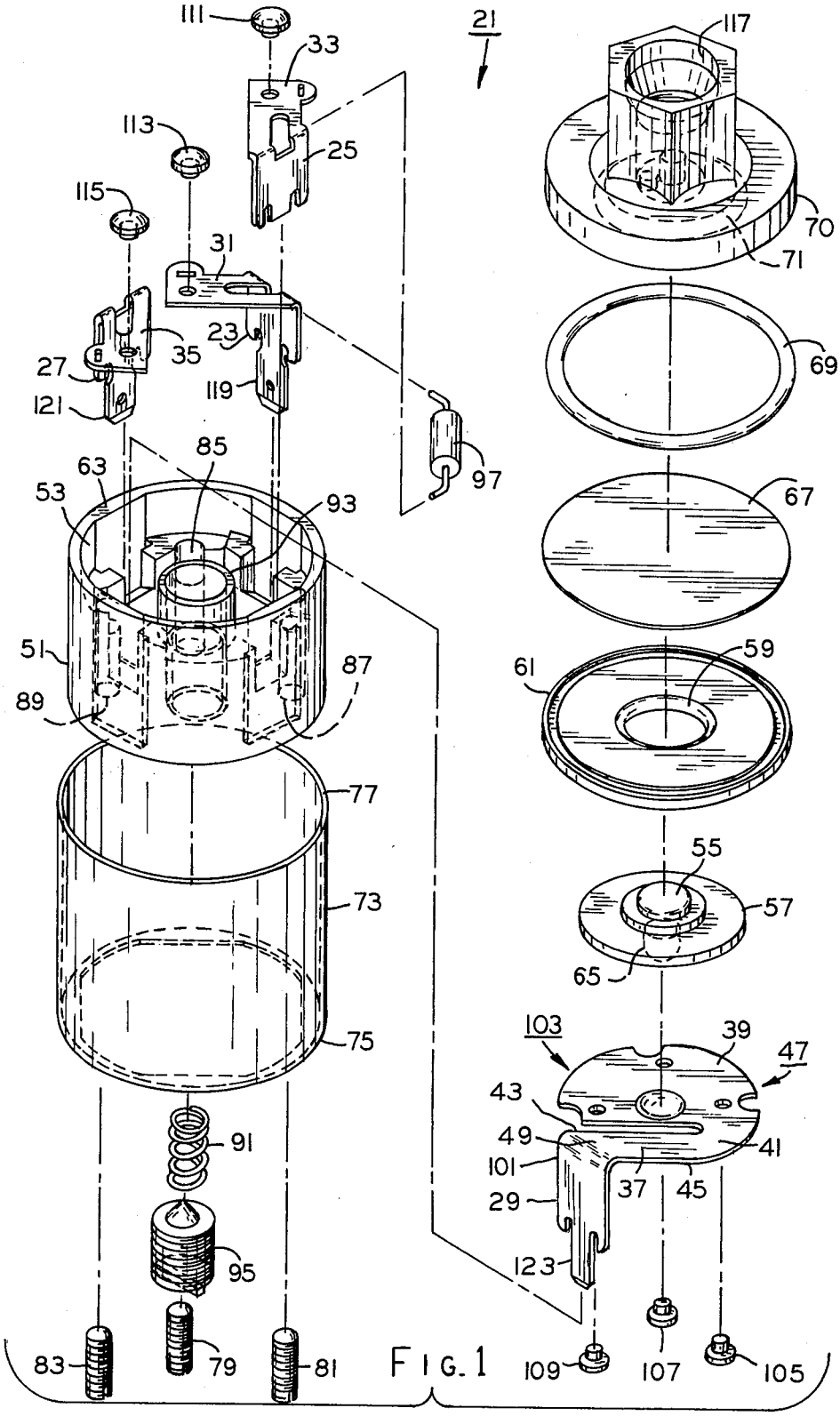
FIG. 1 is an exploded perspective view showing a control device and also teaching principles which may be utilized in a method of manufacturing a control device in one form of the invention and a method of operating a control device, respectively.

Referring now in general to the drawings, there is illustrated in one form of the invention a method of manufacturing or assembling a control device, such as a fluid pressure operated switch 21, having a plurality of electrical circuit elements or components, such as terminals 23, 25, 27, 29 or the like for instance, with some of the terminals, i.e. terminals 23, 25, 27, respectively including contact sections 31, 33, 35 thereon and with another one of the terminals, i.e. terminal 29, including a pair of switch segments 37, 39 with switch segment 37 having a free end portion 41 generally interposed between a pair of generally opposite sides or edges 43, 45 thereof (FIG. 1). In this method, terminals 23, 25, 27, 29 are formed or otherwise configured with contact sections 31, 33, 35 on terminals 23, 25, 27, respectively, and with switch segments 37, 39 on terminal 29, and switch segment 39 is interconnected with switch segment 37 at least generally adjacent free end portion 41 thereof so that switch segment 39 extends at least in part generally laterally beyond either opposite side 43, 45 of switch segment 37 (FIG. 1). Terminals 23, 25, 27 are associated or otherwise mounted with control device 21, and contact sections 31, 33, 35 of the terminals are arranged or otherwise located generally at different elevations in the control device (FIGS. 1–5). Terminal 29 is then associated or otherwise mounted with control device 21, and switch segments 37, 39 are arranged or otherwise disposed so that switch segment 39 extends in overlaying spaced apart relation with contact sections 31, 33, 35 of terminals 23, 25, 27 in the control device (FIGS. 2–5).

More particularly and with specific reference to FIG. 1, terminal 29 and switch segments 37, 39 comprise a switch and terminal combination 47 with switch segment 37 having an end portion 49 opposite free end portion 41 thereof which is integrally associated or otherwise pivotally interconnected with terminal 29. While end portion 49 is illustrated herein as being integrally formed with terminal 29, it is contemplated that the switch segment end portion 49 may be connected by suitable mechanical means, such as riveting or welding or the like for instance, to terminal 29 within the scope of the invention so as to meet at least some of the objects thereof. Thus, opposite sides 43, 45 of switch segment 37 are interposed between opposite end portions 41, 49 thereof, and end portion 41 of switch segment 37 is integrally formed or otherwise interconnected with switch segment 39 so that switch segment 39 extends generally laterally or in spaced relation adjacent opposite side 43 of switch segment 37 in a direction generally from end portion 41 toward the pivoted connection of end portion 49 with terminal 29. Although switch segment 39 is illustrated as extending along opposite side 43 of switch segment 37, it is contemplated that switch segment 39 may also be configured so as to extend along opposite side 45 of switch segment 37 in the direction from end portion 41 toward end portion 49 thereof within the scope of the invention so as to meet at least some of the objects thereof. Of course, switch and terminal combination 47 may be formed or otherwise produced either before, after or simultaneously with terminals 23, 25, 27.

Subsequent to the formation of terminals 23, 25, 27 and switch and terminal combination 47, as discussed above, the terminals are associated or otherwise positioned or mounted in a housing member 51 of control device 21 by suitable means, such as staking or the like for instance, and contact sections 31, 33, 35 of the terminals are arranged or otherwise located generally at different preselected elevations or locations within a switch chamber 53 of the housing member. With terminals 23, 25, 27 so mounted to housing member 51, terminal portion or terminal 29 of switch and terminal combination 47 is also associated or otherwise positioned or mounted in housing member 51 by suitable means, such as staking or the like for instance, and switch segments 37, 39 are disposed in a switch chamber 53 of the housing member with switch segment 39 being arranged or otherwise positioned or disposed generally in overlaying spaced apart relation with contact sections 31, 33, 35 of terminals 23, 25, 27 in the different preselected elevations thereof within the switch chamber, respectively. While terminals 23, 25, 27 are disclosed herein as being mounted to housing member 51 prior to terminal 29 of switch and terminal combination 47, it is contemplated that terminals 23, 25, 27, 29 may be generally simultaneously mounted by suitable means, such as insitu molding or staking or the like for instance, within the scope of the invention so as to meet at least some of the objects thereof.

Upon the mounting of terminals 23, 25, 27 and switch and terminal combination 47 to housing member 51 as discussed above, an opposite end 55 of a plunger 57 is inserted into an opening or aperture 59 through a spacer or annular washer 61, and the spacer is seated or otherwise arranged on housing member 51 generally on an upper or open end or end portion 63 thereof which extends about switch chamber 53 with an opposite end 65 of the plunger engaged with switch segment 39 of the switch and terminal combination. Of course, while opposite end 65 of plunger 57 is illustrated as being engaged with switch segment 39, it is contemplated that plunger end 65 could be engaged with switch segment 37 within the scope of the invention so as to meet at least some of the objects thereof. A diaphragm 67 is associated or otherwise placed or positioned generally in overlaying relation with spacer 61 so as to extend across plunger end 55 in spacer opening 59 and housing member 51 across open end 63 thereof. A seal, such as an O-ring 69 or the like for instance, is disposed in sealing engagement between diaphragm 67 and another housing member 70 generally about a fluid pressure or control chamber 71 therein when housing members 70, 51 are arranged in assembly relation with each other. Upon the placing of housing members 70, 51 in their assembly relation, spacer 61, diaphragm 67 and O-ring 69 are captured between housing members 70, 51 with the diaphragm separating pressure fluid chamber 71 from switch chamber 53. Housing members 70, 51 are secured together against displacement from the assembly position or relation thereof by positioning a metallic sleeve 73 generally about the assembled housing members and forming or deforming a pair of opposite retaining or end portions 75, 77 of the sleeve in displacement preventing engagement with the housing members, respectively.

Subsequent to the above discussed assembly of the component parts of control device 21, a plurality of adjusting means, such as adjusting screws 79, 81, 83 or the like for instance, are adjustably or threadedly received or otherwise disposed in a plurality of threaded openings 85, 87, 89 provided therefor in housing member 51. Adjusting means or screws 79, 81, 83 are abutted or drivingly engaged with contact sections 31, 33, 35 of terminals 23, 25, 27 within switch chamber 53 so as to adjust and maintain the preselected elevations of the contact sections within the switch chamber. Either before, after or simultaneously with the placement of adjusting screws 79, 81, 83 in housing member 51, as discussed above, a range or coil spring 91 is inserted into a guiding hub 93 provided therefor in housing member 51, and another adjusting means, such as an adjusting screw 95 or the like for instance, is threadedly received in a threaded portion of the guiding hub. Opposite ends of spring 91 are abutted with switch segment 39 of switch and terminal combination 47 and adjusting screw 95. Thus, upon the threaded or adjusting engagement of adjusting screw 95 in the threaded portion of guiding hub 93, spring 91 is compressed between switch segment 39 and the adjusting screw, and the compressive force of the spring is transmitted to the switch segment opposing movement thereof toward electrical contacting engagement with contact sections 31, 33, 35 of terminals 23, 25, 27 within switch chamber 53, as discussed in detail hereinafter. While adjusting screws 79, 81, 83, spring 91 and its adjusting screw 95 are disclosed herein as being assembled with housing member 53 after sleeve 73 has been placed in the displacement preventing engagement with housing members 70, 51 in their assembly positions, it is contemplated that such adjusting screws and spring may be assembled with housing 51 at any time either before or after terminals 23, 25, 27 and switch and terminal combination 47 are assembled therewith, as discussed hereinabove, within the scope of the invention so as to meet at least some of the objects thereof. Further, it is also contemplated that an impedance element, such as a resistor 97 or the like for instance, may be electrically connected by suitable means, such as soldering or crimping or the like for instance, between terminals 23, 25 either before or after such terminals are mounted to housing member 51, as discussed hereinbefore, so that the impedance element or resistor is disposed within switch chamber 53.

Figure 2:
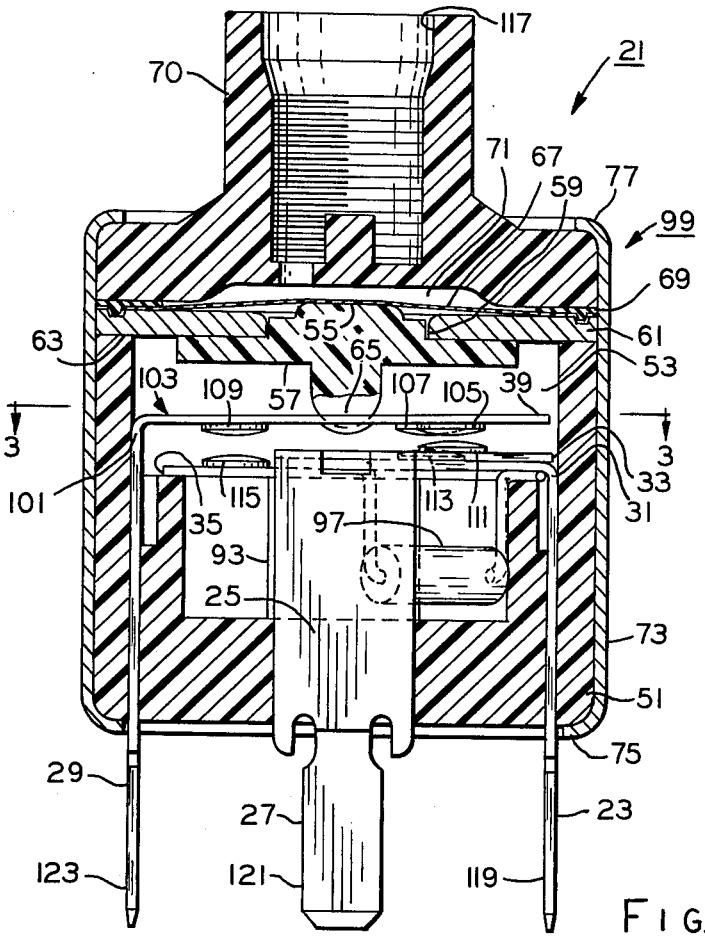
FIG. 2 is a sectional view of the control device of FIG. 1.
Figure 3:
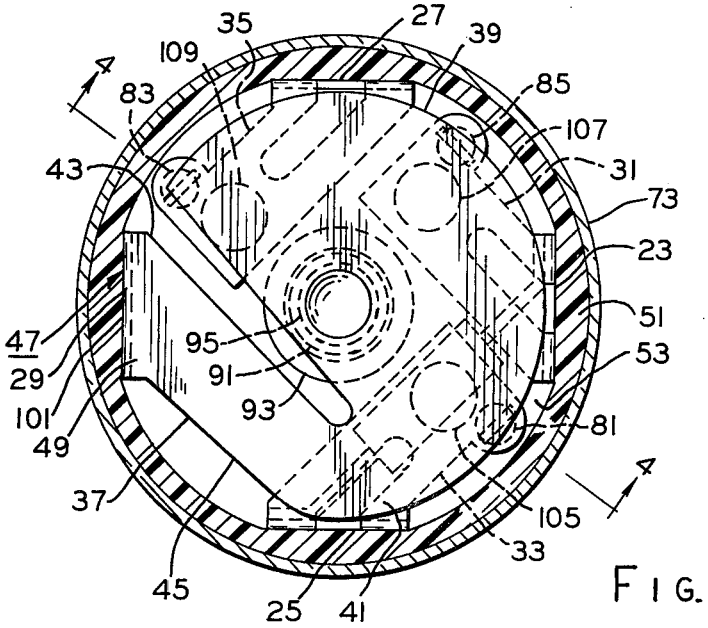
FIGS. 3 and 4 are sectional views taken along lines 3—3 of FIG. 2 and 4—4 of FIG. 3, respectively.
Figure 4:
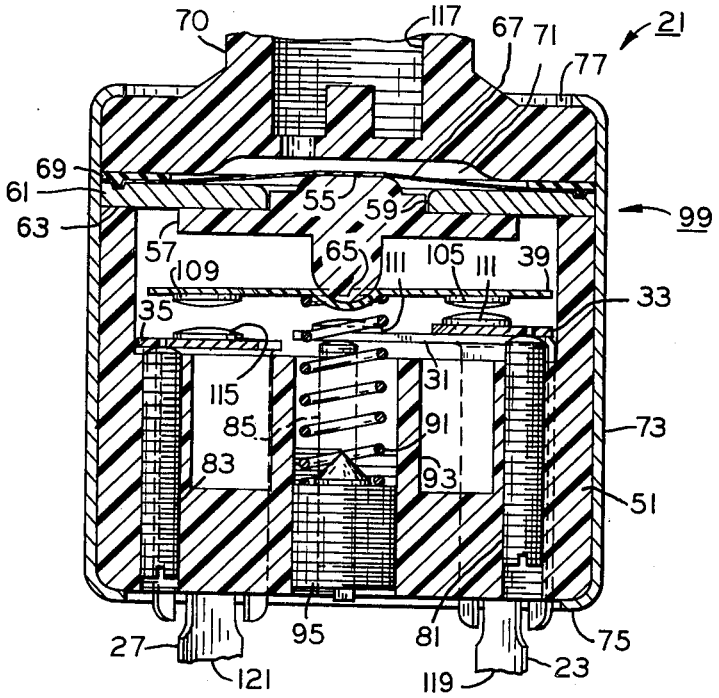

With reference again to the drawings in general and recapitulating at least in part with respect to the foregoing, control device 21 is provided with a housing 99 having switch chamber 53 therein (FIGS. 2 and 4). Terminals 23, 25, 27 are associated with housing 99 and have at least a part thereof within switch chamber 53. The at least parts of some of the terminals, i.e. terminals 23, 25, 27 define contact sections 31, 33, 35 each arranged at a different preselected elevation within switch chamber 53, and the at least part of terminal 29 defines a switch means supporting section 101 within the switch chamber (FIGS. 1 and 4). A switch means 103 within switch chamber 53 is both pivotally and rockably movable for sequential electrical contacting engagement with contact sections 31, 33, 35 of terminals 23, 25, 27, and the switch means includes switch segments 37, 39 (FIGS. 1 and 4). Switch segment 37 is connected with supporting section 101 of terminal 29 within switch chamber 53 and has opposite sides 43, 45 thereon, and switch segment 39 is connected with switch segment 37 so as to extend beyond either opposite side thereof in overlaying spaced relation with contact sections 31, 33, 35 of terminals 23, 25, 27 (FIG. 4). Means, such as at least diaphragm 67, is movable in housing 99 and operable generally for exerting a force on switch means 103 (FIGS. 1–3). In response to the actuating force, switch means 103 is initially pivotally movable about support section 101 of terminal 29 so as to effect the electrical contacting engagement of a part, such as an electrical contact 105 or the like for instance, on switch segment 39 with contact section 33 of terminal 25, and the switch means is thereafter further rockably movable generally about at least the terminal support section and the electrical contacting engagement of contact 105 with terminal contact section 33 so as to sequentially effect the electrical contacting engagement of at least another part, such as another electrical contact 107 or the like for instance, on switch segment 39 with at least another contact section on at least another of the terminals, such as contact section 31 of terminal 23 for instance (FIGS. 1–4).

More particularly and with specific reference to FIGS. 1–4, switch segment 39 is also provided with another electrical contact 109 defining at least another part thereof for electrical contacting engagement with contact section 35 of terminal 27. Thus, when the aforementioned actuating force is exerted on switch means 103, switch segments 37, 39 are still further rockably movable not only about support section 101 of terminal 29 but also about both of the electrical contacting engagements of contacts 105, 107 with terminal contact sections 31, 33 so as to sequentially make contact 109 in electrical contacting engagement with terminal contact section 35. While electrical contacts 105, 107, 109 are disclosed herein as being connected or otherwise mounted by suitable means to switch segment 39, it is contemplated that other contact means, such as indentations or dimples or the like for instance, may be integrally provided in switch segment 39 for the electrical contacting engagement with terminal contact sections 31, 33, 35 generally in the same manner as discussed above within the scope of the invention so as to meet at least some of the objects thereof. Switch and terminal combination 47 may be formed from any suitable material, such as beryllium copper or the like for instance, having desired electrical conductivity and strength characteristics. It may be noted that switch segments 37, 39 are arranged generally in coplanar relation in the at-rest positions thereof, and switch segment 39 extends from its interconnection with switch segment 37 at least generally adjacent free end portion 41 thereof generally in laterally spaced relation along opposite side 43 of switch segment 37 in a direction from the free end portion generally toward pivoted end portion 49 of switch segment 37. Thus, switch segments 37, 39 are bifurcated with a bight section being defined therebetween generally at the interconnection of switch segment 39 with free end portion 41 of switch segment 37. While switch segments 37, 39 are disclosed herein as being generally coplanar, it is contemplated that at least parts of the switch segments may be canted or otherwise angularly disposed with respect to other parts thereof within the scope of the invention so as to meet at least some of the objects thereof.

Contact sections 31, 33, 35 of terminals 23, 25, 27 include contacts 111, 113, 115 for the aforementioned sequential electrical contact or making engagement with contacts 105, 107, 109 of switch segment 39, respectively; however, it is contemplated that the terminal contact sections may be formed with other contact means, such as indentations or dimples or the like for instance, within the scope of the invention so as to meet at least some of the objects thereof. A control port 117 is provided in housing member 70 in pressure fluid communication with pressure fluid chamber 71 therein, and the control port is adapted to be subjected to a control fluid pressure. Terminals 23, 27, 29 are provided with electrical connector sections 119, 121, 123 which extend exteriorly of housing member 51 so as to receive quick connect or quick disconnect electrical fittings (not shown). While control device 21 is provided with three terminals 23, 25, 27 with contact sections 31, 33, 35 thereon, respectively, it is contemplated that only two of such terminals may be utilized in the sequential electrical contacting engagement therewith of switch means 103 within the scope of the invention so as to meet at least some of the objects thereof.

In the operation of control device 21, assume that the component parts thereof are disposed in the at-rest positions as described hereinabove and as shown in FIGS. 1–4. When control port 117 is subjected to a control fluid pressure of a preselected value, the control fluid pressure is also established in fluid pressure chamber 71 acting on the effective area of diaphragm 67 to create an actuating force which is exerted or transmitted through plunger 57 onto switch segment 39. In response to this actuating force, switch segments 37, 39 are initially conjointly pivotally moved generally about the pivoted connection of switch segment pivoted end portion 49 with support section 101 of terminal 29 until contact 105 on switch segment 39 makes in electrical contacting engagement with contact 111 of contact section 33 on terminal 25, and it may be noted that during this conjoint pivotal movement, switch segments 37, 39 are maintained generally in the coplanar relation thereof.

When the fluid pressure at control port 117 is increased to another preselected value in excess of the first named preselected value thereof, the actuating force is also correspondingly increased. In response to the increased actuating force, switch segments 37, 39 are conjointly rockably moved generally about the pivoted connection of switch segment end portion 49 with support section 101 of terminal 29 and also the electrical contacting engagement of contacts 105, 111, respectively, on switch segment 39 and terminal contact section 33 until contact 107 on switch segment 39 makes in electrical contacting engagement with contact 113 of contact section 31 on terminal 23. It may be noted that during this conjoint rocking movement of switch segments 37, 39, the switch segments are deflected from the generally coplanar relation thereof. For instance, at least a portion of switch segment 37 is believed to be deflected or otherwise twisted at least between the free end 41 of switch segment 37 and the pivotal connection of switch segment end portion 49 with support section 101 of terminal 29. In addition, at least a portion of switch segment 39 is believed to be deflected or otherwise twisted at least generally about the connection of switch segment 39 with free end portion 41 of switch segment 37. Thus, the conjoint deflection or twisting of switch segments 37, 39 permits the aforementioned conjoint rocking movement thereof.

When the fluid pressure at control port 117 is further increased to a third preselected value in excess of the aforementioned another preselected value thereof, the actuating force is further correspondingly increased. In response to this further increased actuating force, switch segments 37, 39 are further rockably moved generally about the pivoted connection of switch segment end portion 49 with support section 101 of terminal 29 and also about both of the electrical contacting engagements of switch segment contacts 105, 107 with contact section contacts 111, 113, respectively, until contact 109 on switch segment 39 makes in electrical contacting engagement with contact 115 of contact section 35 on terminal 27. It may be noted that during this further rocking movement of switch segments 37, 39, the switch segments are believed to be further twisted or deflected generally in the same manner as discussed hereinabove. It may also be noted that the disposition of contacts 111, 113, 115 of contact sections 31, 33, 35 on terminals 23, 25, 27 at the different preselected elevations thereof within switch chamber 53 generally defines an imaginary plane between the three contacts. Thus, when switch segment 39 becomes engaged with contacts 111, 113, 115 in the imaginary plane thereof, switch segment 39 is maintained against further rocking movement in response to any further increases which may occur in the fluid pressure at control port 117 which, of course, would effect further corresponding increases in the actuating force exerted on switch segment 39.

Figure 11:
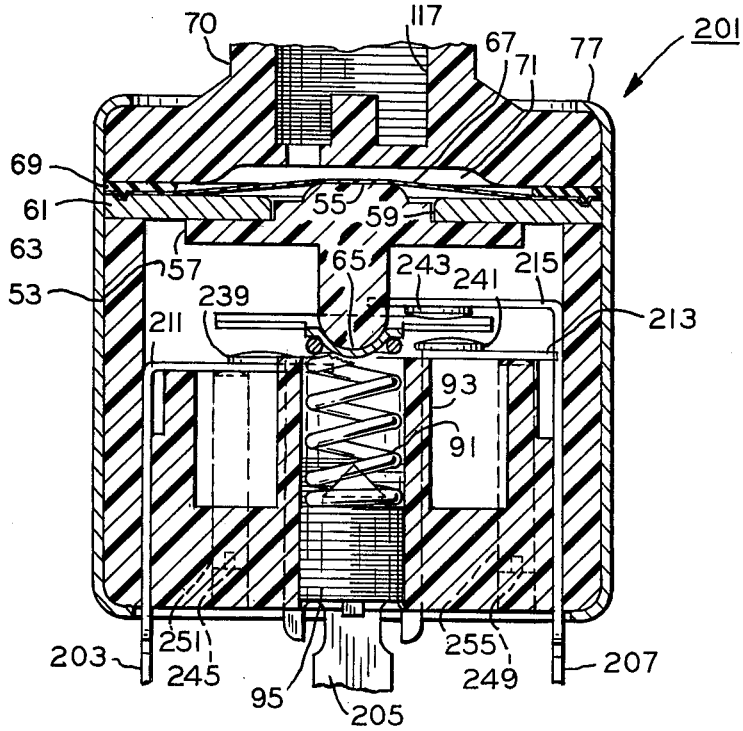
FIG. 11 is a sectional view taken along line 11—11 in FIG. 10.

With reference again to the drawings in general and again recapitulating at least in part with respect to the foregoing, there is illustrated a method of operating control device 21 (FIGS. 11–4). In this method, an actuating force is exerted on one of switch segments 37, 39. In response to this actuating force, switch segments 37, 39 are generally conjointly pivoted generally about the connection of switch segment end 49 with support section 101 of terminal 29, and a part, such as contact 105 for instance, of switch segment 39 is engaged in electrical contact with contact section 33 of terminal 25. Switch segments 37, 39 are then generally conjointly rocked in response to the actuating force exerted thereon generally about the connection of switch segment end 49 with terminal support section 101 and also about the engagement of the switch segment part, i.e. contact 105 for instance, and terminal contact section 33, and at least another part, i.e. contacts 107, 109 for instance, of switch segment 39 is engaged in electrical contact with at least another contact section, i.e. contact sections 31, 35 for instance, of at least another of the terminals, i.e. terminals 23, 27 for instance.

Figure 5:
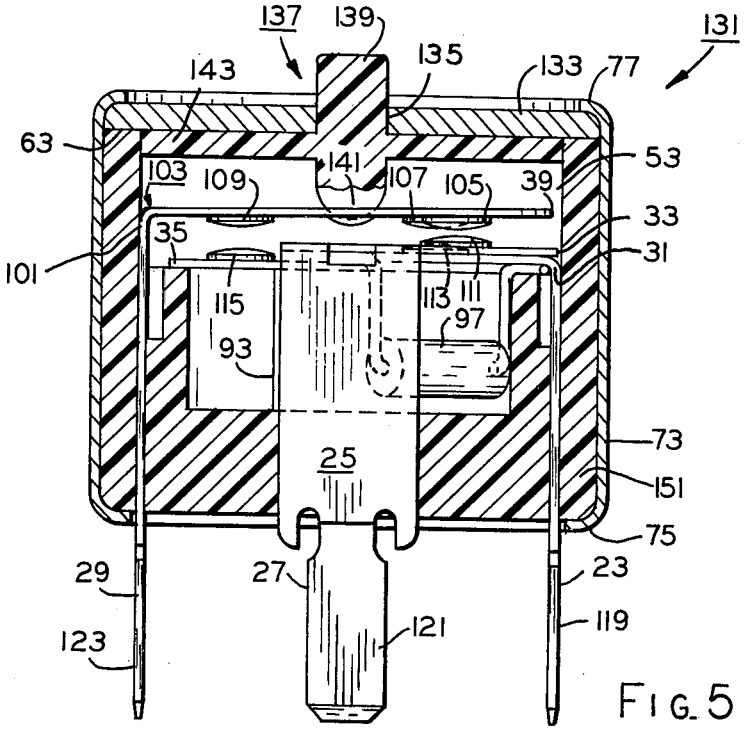
FIG. 5 is a sectional view illustrating an alternative control device.

An alternative control device 131 is illustrated in FIG. 5 having generally the same component parts and functioning generally in the same manner as the previously described control device 21 with the exceptions discussed hereinafter.

Control device 131 has a housing member or cover 133 which is seated on upper end 63 of housing member 51 so as to close switch chamber 53 therein, and free end 77 of sleeve 73 is deformed into engagement with cover 133 retaining it against displacement from its seated or assembly position on housing member 51. An opening 135 is generally centrally provided through cover 133, and means, such as a plunger or push button 137 or the like for instance, is reciprocally received or movable in the cover opening for exerting the actuating force on switch means 103. Exerting means or plunger 137 is provided with a manual force receiving end 139 which extends exteriorly of cover 133 and a generally opposite end 141 interiorly of switch chamber 53 in abutting or force transmitting engagement with switch means 103. To complete the description of control device 131, a generally radially extending flange 143 is provided on plunger 137 at least in part in sliding or guiding engagement with the sidewall of housing member 51 defining switch chamber 53, and the compressive force of spring 91 biased against switch means 103 urges the plunger toward an at-rest position abutting plunger flange 143 against cover 133. Thus, when a manually applied or other actuating force is exerted on plunger exterior end 139, plunger 137 is moved downwardly in switch chamber 53 to transmit the actuating force onto switch means 103 effecting the operation thereof in the same manner as discussed hereinbefore with respect to control device 21.

Figure 6:
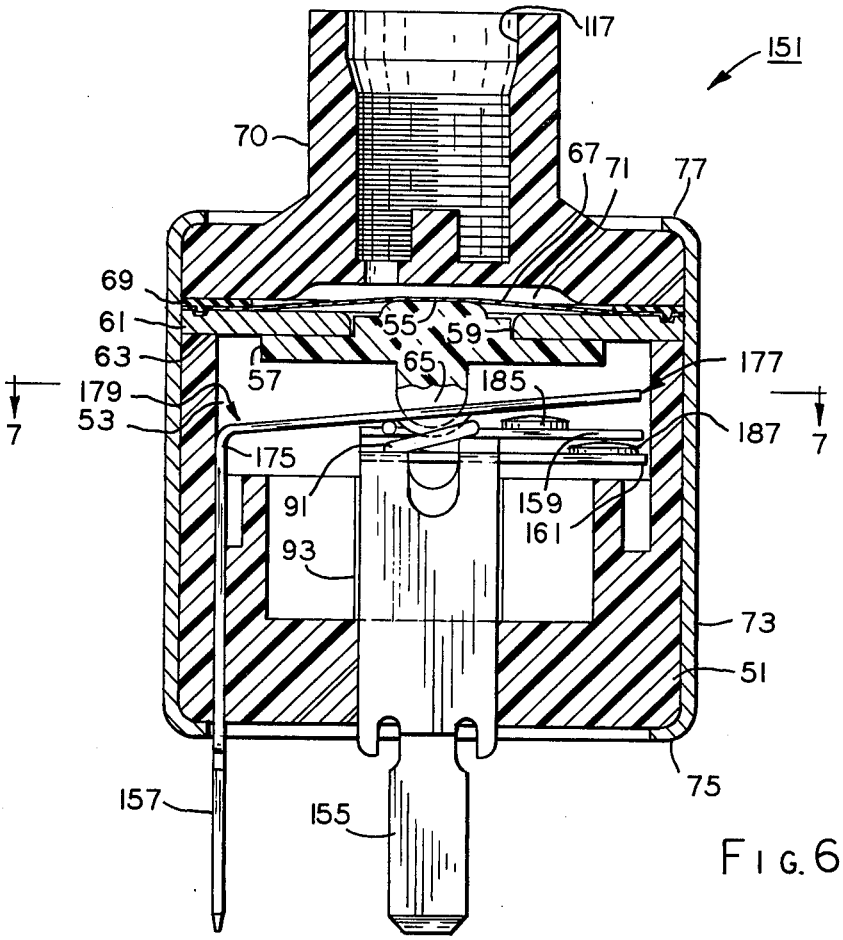
FIG. 6 is a sectional view showing another alternative control device and also teaching principles which may be practiced in another alternative method of manufacturing a control device in one form of the invention and another alternative method of operating a control device, respectively.
Figure 7:
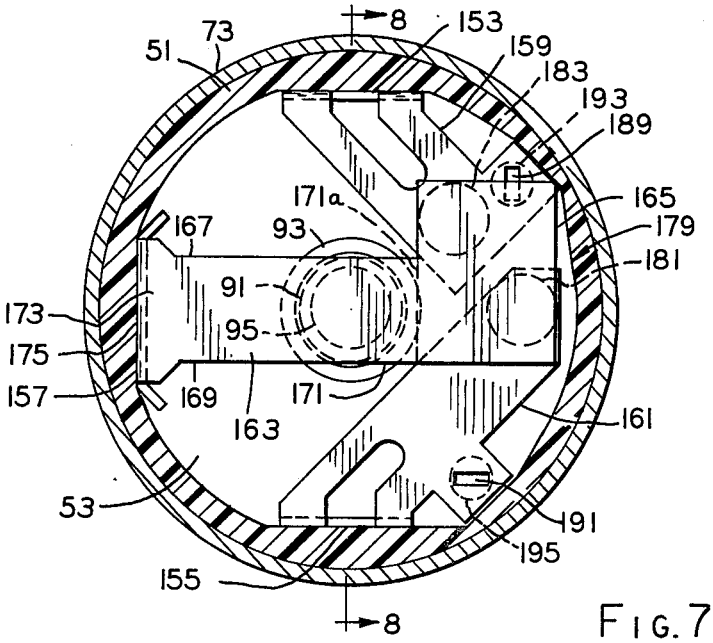
FIG. 7 is a sectional view taken along line 7—7 of FIG. 6.
Figure 8:
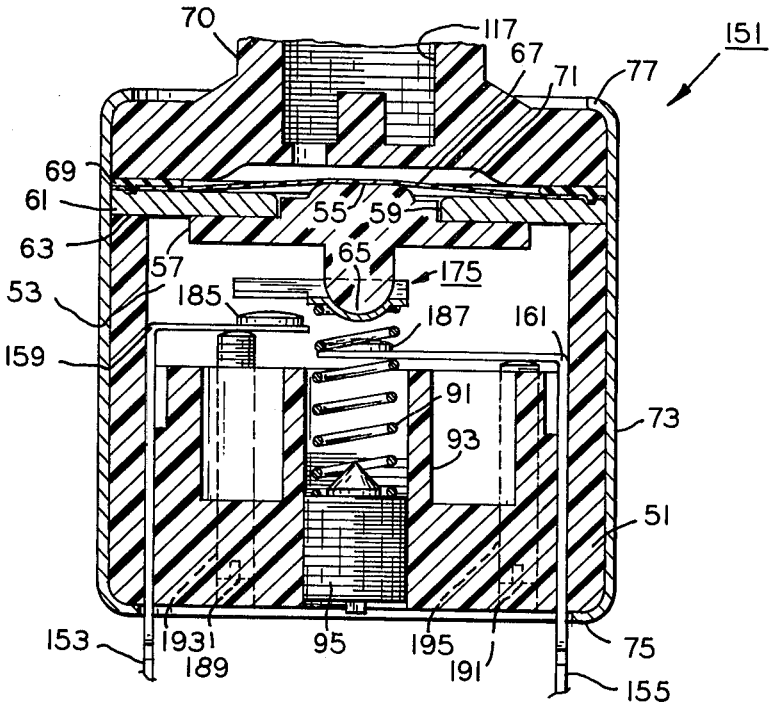
FIG. 8 is a sectional view taken along line 8—8 of FIG. 7.

Another alternative control device 151 is illustrated in FIGS. 6–8 having generally the same component parts and functioning generally in the same manner as the previously discussed control device 21 with the exceptions set out hereinafter.

Control device 151 is provided with a plurality of electrical circuit elements or components, such as terminals 153, 155, 157 or the like for instance, with some of the terminals, i.e., terminals 153, 155, including contact sections 159, 161 formed thereon. It may be noted that contact sections 159, 161 of terminals 153, 155 are arranged at different preselected elevations or levels within switch chamber 53. Another one of the terminals, i.e., terminal 157 includes a pair of generally coplanar switch segments 163, 165, and switch segment 163 has a pair of opposite sides or edges 167, 169 interposed between a pair of generally opposite pivoted and free ends or end portions 171, 173 with free end portion being terminated generally at dotted line **171*a*. Switch segment 165 is integrally formed or otherwise interconnected with switch segment 163 at least generally adjacent free end portion 171 thereof, and switch segment 165 extends at least in part generally laterally beyond opposite side 167 of switch segment 163 and also in a direction defined between free end portion 171 and pivoted end portion 173 of switch segment 163. Pivoted end portion 173 of switch segment 163 is integrally formed with a switch means supporting section 175 on terminal 157. Thus, switch segments 163, 165 comprise a switch or switch means indicated generally at 177, and terminal 157 and switch segments 163, 165 comprise a switch and terminal combination indicated generally at 179. While pivoted end portion 173 of switch segment 163 is shown as being integrally formed with terminal supporting section 175, it is contemplated that the pivoted end portion may be secured or otherwise connected by suitable means, such as riveting or welding or the like for instance, to the terminal supporting section within the scope of the invention so as to meet at least some of the objects thereof. Further, while switch segment 165 is disclosed as extending beyond side 167 of switch segment 163, it is also contemplated that switch segment 165 may extend beyond opposite side 169 of switch segment 163 within the scope of the invention so as to meet at least some of the objects thereof. Thus, switch segment 165 may be arranged to extend beyond either opposite side 167, 169 of switch segment 163**.

A pair of electrical contacts 181, 183 are provided on switch segment 165 for making in electrical contacting engagement with another pair of contacts 185, 187 included on contact sections 159, 161 of terminals 153, 155. A pair of adjusting means, such as adjusting screws 189, 191 or the like for instance, are adjustably or threadedly received in a pair of threaded openings 193, 195 provided therefor in housing member 51, and the adjusting screws are abutted or otherwise drivingly engaged with contact sections 159, 161 of terminals 153, 155 within switch chamber 53 so as to adjust and/or maintain the preselected elevations of the contact sections within the switch chamber. To complete the description of control device 151, range spring 91 is biased against switch segment 163 of switch means 175 opposing movement thereof toward contact sections 159, 161 on terminals 153, 155 and toward abutment with end portion 65 of plunger 57.

In the operation of control device 151, assume that the component parts thereof are disposed in the at-rest positions as described hereinabove and as shown in FIGS. 6–8. When control port 117 is subjected to a control fluid pressure of a preselected value, the control fluid pressure is also established in fluid pressure chamber 71 acting on the effective area of diaphragm 67 to create an actuating force which is exerted or transmitted through plunger 57 onto switch segment 163. In response to this actuating force, switch segments 163, 165 are initially conjointly pivotally moved generally about the pivoted connection of switch segment pivoted end portion 173 with support section 175 of terminal 157 until contact 183 on switch segment 165 makes in electrical contacting engagement with contact 185 of contact section 159 on terminal 153, and it may be noted that during this conjoint pivotal movement, switch segments 163, 165 are maintained generally in the coplanar relation thereof.

When the fluid pressure at control port 117 is increased to another preselected value in excess of the first named preselected value thereof, the actuating force is also correspondingly increased. In response to the increased actuating force, switch segments 163, 165 are conjointly rockably moved generally about the pivoted connection of switch segment end portion 173 with support section 175 of terminal 157 and also the electrical contacting engagement of contacts 183, 185, respectively, on switch segment 165 and terminal contact section 159 until contact 181 on switch segment 165 makes in electrical contacting engagement with contact 187 of contact section 161 on terminal 155. It may be noted that during this conjoint rocking movement of switch segments 163, 165, the switch segments are deflected from the generally coplanar relation thereof. For instance, at least a portion of switch segment 163 is believed to be deflected or otherwise twisted at least between the free end 171 of switch segment 163 and the pivotal connection of switch segment end portion 173 with support section 175 of terminal 157. In addition, at least a portion of switch segment 165 is believed to be deflected or otherwise twisted at least generally between contacts 181, 183 thereon. Thus, the conjoint deflection or twisting of switch segments 163, 165 permits the aforementioned conjoint rocking movement thereof.

With respect to FIGS. 9–11, another alternative control device 201 is shown having generally the same component parts and functioning generally in the same manner as the previously described control device 21 with the exceptions noted hereinafter.

Control device 201 is provided with a plurality of electrical circuit elements, such as terminals 203, 205, 207, 209 or the like for instance, with some of the terminals, i.e., terminals 203, 205, 207, including contact sections 211, 213, 215 formed thereon. It may be noted that contact sections 211, 213, 215 of terminals 203, 205, 207 are arranged or otherwise located at different preselected elevations or levels within switch chamber 53. Another one of the terminals, i.e., terminal 209, includes a pair of generally coplanar switch segments 217, 219, and switch segment 217 has a pair of opposite sides or edges 221, 223 interposed between a pair of generally opposite ends or end portions, such as pivotal end portion 225 and free end portion 227 for instance. Switch segment 219 is integrally formed or otherwise interconnected with switch segment 217 at least generally adjacent end portion 227 thereof, and switch segment 219 extends at least in part generally laterally beyond either opposite side 221, 223 of switch segment 217 as well as generally in the direction defined between opposite end portions 225, 227 of switch segment 217. Pivoted end portion 225 of switch segment 217 is integrally or otherwise interconnected with a switch means supporting section 229 on terminal 209. Thus, switch segments 217, 219 comprise a switch or switch means, indicated generally at 231, and terminal 209 and the switch segments comprise a switch and terminal combination indicated generally at 233. Of course, while pivoted end 225 of switch segment 217 is disclosed as being integrally formed with supporting sections 229 of terminal 209, it is contemplated that the pivoted end portion may be secured or otherwise interconnected by suitable means, such as riveting or welding or the like for instance, to the terminal supporting section within the scope of the invention so as to meet at least some of the objects thereof.

Switch segment 219 includes a pair of contacts 235, 237, and contact sections 211, 213, 215 include contacts 239, 241, 243, respectively; however, it is contemplated that other contact means, such as dimples or other protrusions or the like for instance, may be provided on either the switch segment and the contact sections within the scope of the invention so as to meet at least some of the objects thereof. Of course, during the manufacture or assembly of control device 201, terminals 203, 205, 207 may be formed either before, after or generally simultaneously with switch and terminal combination 233. Further, terminals 203, 205 may be mounted to housing 99 and within switch chamber 53 either before or generally simultaneously with switch and terminal combination 233, and terminal 207 may be subsequently mounted to the housing within the switch chamber; however, it may be noted that switch segment 219 is disposed in overlaying relation with contact sections 211, 213, 215 of terminals 203, 205, 207, respectively. In control device 201, the compressive force of spring 91 engaged with switch segment 217 urges switch means 231 in a direction so as to engage contact 237 on switch segment 219 with contact 243 on contact section 215 of terminal 207, and end portion 65 of plunger 57 is drivingly engaged with switch segment 217 of switch means 231. A plurality of adjusting means, such as adjusting screws 245, 247, 249 or the like for instance, are adjustably or threadedly received in threaded openings 251, 253, 255 provided therefor in housing member 51, and the adjusting screws are abutted or otherwise drivingly engaged with contact sections 211, 213, 215 of terminals 203, 205, 207 within switch chamber 53 so as to adjust and/or maintain the preselected elevations of the contact sections within the switch chamber.

Figure 9:
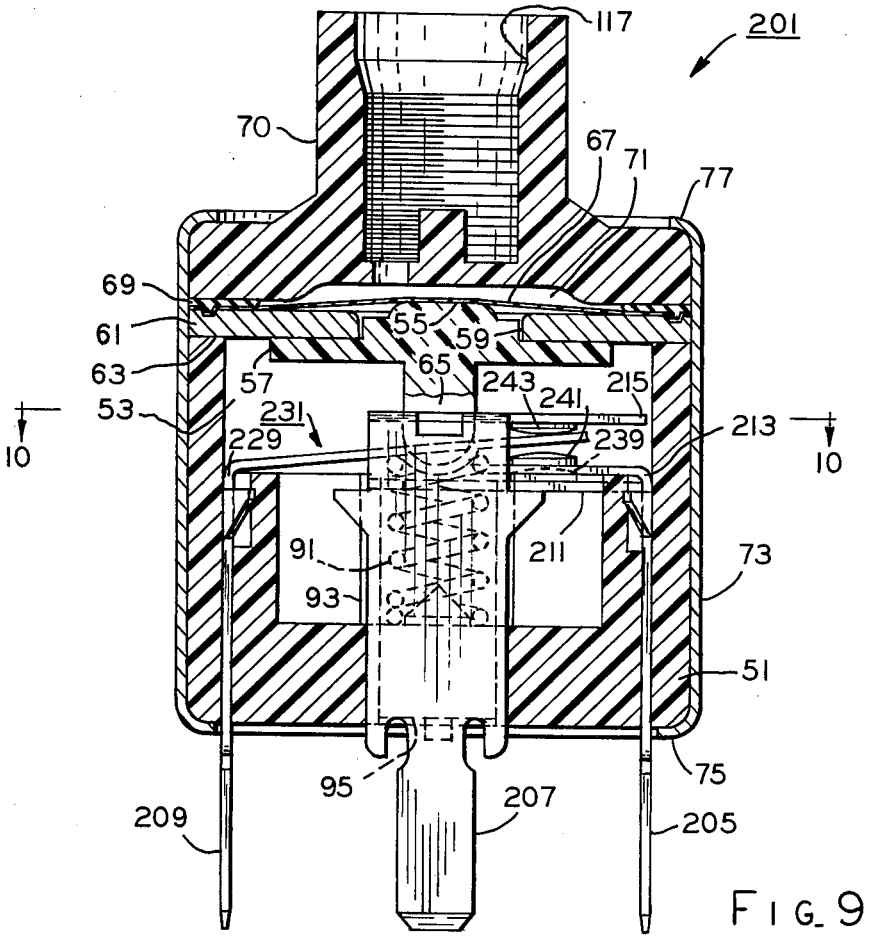
FIG. 9 is a sectional view illustrating still another alternative control device and also teaching principles which may be practiced in still another alternative method of operating a control device and still another alternative method of manufacturing a control device in one form of the invention, respectively.
Figure 10:
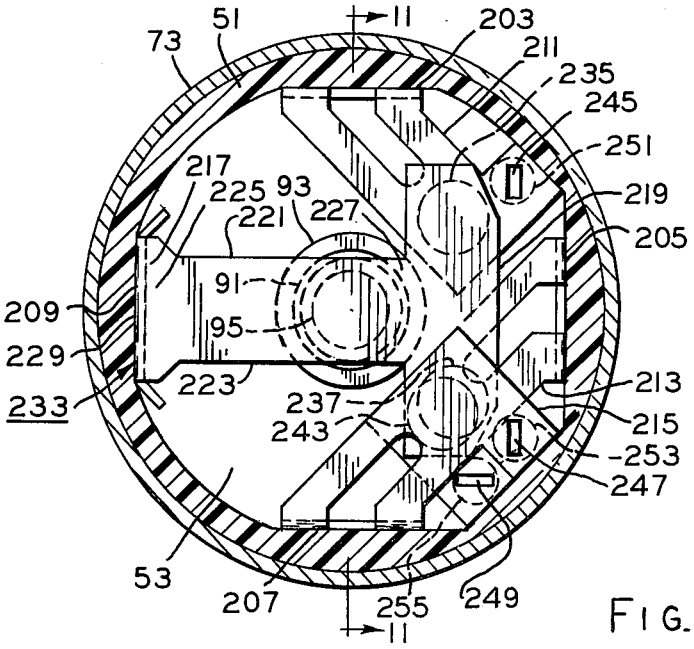
FIG. 10 is a sectional view taken along line 10—10 in FIG. 9.

In the operation of control device 201, assume that the component parts thereof are disposed in the at-rest positions as described hereinabove and as shown in FIGS. 9–11. When control port 117 is subjected to a control fluid pressure of a preselected value, the control fluid pressure is also established in fluid pressure chamber 71 acting on the effective area of diaphragm 67 to create an actuating force which is exerted or transmitted through plunger 57 onto switch segment 217. In response to this actuating force, switch segments 217, 219 are initially conjointly pivotally moved generally about the pivoted connection of switch segment pivoted end portion 225 with support section 229 of terminal initially disengaging contact 237 on switch segment 219 from contact 243 on contact section 215 of terminal 207 and then making contact 237 on switch segment 219 in electrical contacting engagement with contact 241 of contact section 213 on terminal 205, and it may be noted that during this conjoint pivotal movement, switch segments 217, 219 are maintained generally in the coplanar relation thereof.

When the fluid pressure at control port 117 is increased to another preselected value in excess of the first named preselected value thereof, the actuating force is also correspondingly increased. In response to the increased actuating force, switch segments 217, 219 are conjointly rockably moved generally about the pivoted connection of switch segment end portion 225 with support section 229 of terminal 209 and also the electrical contacting engagement of contacts 237, 241, respectively, on switch segment 219 and terminal contact section 213 until contact 235 on switch segment 219 makes in electrical contacting engagement with contact 239 of contact section 211 on terminal 203. It may be noted that during this conjoint rocking movement of switch segments 217, 219, the switch segments are deflected from the generally coplanar relation thereof. For instance, at least a portion of switch segment 217 is believed to be deflected or otherwise twisted at least between the free end 227 of switch segment 217 and the pivotal connection of switch segment end portion 225 with support section 229 of terminal 209. In addition, at least a portion of switch segment 219 is believed to be deflected or otherwise twisted at least generally about the connection of switch segment 219 with free end portion 227 of switch segment 217. Thus, the conjoint deflection or twisting of switch segments 217, 219 permits the aforementioned conjoint rocking movement thereof.

From the foregoing, it is now apparent that a novel method of manufacturing a control device has been presented meeting the objects and advantageous features set out hereinbefore, as well as others, and it is contemplated that changes as to the precise arrangements, shapes, details and connections of the components utilized in such control device and such novel method, as well as in the precise order of the method steps, may be made by those having ordinary skill in the art without departing from the spirit of the invention or the scope thereof, as set out in the claims which follow.

What I claim as new and desire to secure by Letters Patent of the United States is: electrical engagement with a third one of said contacts.

1. A method of manufacturing a control device having a plurality of electrical circuit elements with some of the electrical circuit elements respectively including a contact section thereon and with another one of the electrical circuit elements including a pair of switch segments with at least one of the switch segments having a free end portion interposed between a pair of generally opposite sides thereof, the method comprising the steps of:

forming the electrical circuit elements with the contact sections on the some electrical circuit elements, respectively, and with the switch segments on the another one electrical circuit element and interconnecting the other of the segments with the at least one switch segment at least generally adjacent the free end portion thereof so that the other switch segment extends at least in part generally laterally beyond either opposite side of the at least one switch segment;

associating the some electrical circuit elements with the control device and arranging the respective contact sections of the some electrical circuit elements at different elevations in the control device; and associating the another one electrical circuit element with the control device and disposing the switch segments so that the other switch segment extends in overlaying spaced apart relation with the contact sections of the some electrical circuit elements in the control device.

2. A method of manufacturing a control device having a housing with a chamber therein, a plurality of terminals each having a contact section thereon, and a switch and terminal combination including another terminal, a pair of bifurcated switch segments having a bight portion therebetween, and a pair of generally opposite sides on at least one of the switch segments extending generally from the bight portion, the method comprising the steps of:

forming the switch segments and another terminal integrally with each other with said at least one switch segment being pivotally interconnected with the another terminal remote from the bight portion and with the other of the switch segments extending generally adjacent either opposite side of the at least one switch segment in a direction from the bight portion generally toward the another terminal;

associating the terminal plurality with the housing and arranging the contact sections of the terminal plurality generally at different preselected elevations within the chamber, respectively; and associating the another terminal with the housing and disposing the switch segments in the chamber so that the other switch segment extends in overlaying spaced apart relation with the contact sections of the terminal plurality, respectively.

3. A method of manufacturing a control device having first and second housing members, a pressure fluid chamber in the first housing member and having a first open end, a switch chamber in the second housing member and having a second open end, a spacer having an opening therethrough, a plunger having a pair of opposite abutment ends, a diaphragm, a plurality of terminals each having a contact section thereon, and a switch and terminal combination including a terminal portion and a pair of switch segments with at least one of the switch segments having a pair of generally opposite sides interposed between a pair of generally opposite end portions, the method comprising the steps of:

interconnecting the opposite end portions of the at least one switch segment with the terminal portion and the other of the switch segments, respectively, with the other switch segment extending generally beyond either opposite side of the at least one switch segment;

mounting the terminal plurality to the second housing member and arranging the contact sections of the terminal plurality generally at different preselected elevations in the switch chamber of the second housing member;

mounting the terminal portion of the switch and terminal combination to the second housing member and disposing the at least one switch segment and the other switch segment within the switch chamber with the other switch segment being arranged generally in overlaying spaced apart relation with the contact sections of the terminal plurality, respectively;

inserting one of the opposite ends of the plunger into the opening in the spacer and seating the spacer on the second housing member generally about the second open end of the switch chamber in the second housing member with the other opposite end of the plunger engaged with one of the at least one switch segment and the other switch segment;

associating the diaphragm generally in overlaying relation with the spacer seated on the second housing member so as to extend across the one opposite end of the plunger in the spacer opening;

arranging the first and second housing members generally in assembly relation with each other and capturing at least the spacer and the diaphragm between the first and second housing members with the diaphragm separating the pressure fluid chamber from the switch chamber; and securing the first and second housing members together against displacement from the assembly relation thereof.

4. A method of manufacturing a control device having a housing with a chamber therein, a plurality of electrical circuit elements each having a contact section thereon, a switch and terminal combination including a terminal, a pair of switch segments with one of the switch segments having a pair of generally opposite sides interposed between a pivoted end portion and a free end portion, respectively, the method comprising the steps of:

interconnecting the pivoted end portion of the one switch segment with the terminal and forming the other of the switch segments integrally with the free end portion of the one switch segment so that the other switch segment extends generally adjacent either opposite side of the at least one switch segment in a direction generally from the free end portion toward the pivoted end portion thereof;

mounting the electrical circuit elements with the housing and locating the contact sections at least generally in different preselected elevations within the chamber of the housing, respectively;

associating the terminal of the switch and terminal combination with the housing and disposing the switch segments of the switch and terminal combination within the chamber of the housing with the other switch segment extending in overlaying spaced apart relation with the contact sections of the electrical circuit elements located in the chamber of the housing.

5. A method of manufacturing a control device having a housing with a chamber therein, a plurality of electrical circuit elements each having a contact section, and a switch and terminal combination including a terminal, and a pair of switch segments, one of the switch segments having a pair of opposite sides interposed between a pair of opposite end portions, respectively, the method comprising the steps of:

interconnecting one of the opposite end portions on the one switch segment pivotally with the terminal and forming the other of the switch segments integrally with the one switch segment at least generally adjacent the other of the opposite end portions thereof so that the other switch segment extends beyond either opposite side on the one switch segment;

mounting the electrical circuit elements and the terminal of the switch and terminal combination to the housing with at least the contact sections and the switch segments being disposed within the chamber and arranging the contact sections at different preselected elevations within the chamber with at least one of the one and other switch segments being in overlaying relation with the contact section of the electrical circuit elements.

* * * * *